United States Patent [19]

Cernak et al.

[11] Patent Number: 4,634,316

[45] Date of Patent: Jan. 6, 1987

[54] COMPACTED DEEP FOUNDATION STRUCTURE, METHOD OF AND APPARATUS FOR BUILDING THE SAME

[75] Inventors: Boris Cernak; Karol Klein, both of Bratislava, Czechoslovakia

[73] Assignee: Vyzkumny ustav inzenierskych stavieb, Bratislava, Czechoslovakia

[21] Appl. No.: 686,721

[22] Filed: Dec. 27, 1984

[30] Foreign Application Priority Data

Dec. 27, 1983 [CS] Czechoslovakia ..... 9989-83

[51] Int. Cl.[4] ..... E02D 5/00

[52] U.S. Cl. ..... 405/229; 405/230; 405/258

[58] Field of Search ..... 405/229, 269, 230, 258, 405/271

[56] References Cited

U.S. PATENT DOCUMENTS

| | | | |
|---|---|---|---|
| 1,254,401 | 1/1918 | Cole et al. | 405/229 X |
| 2,381,014 | 8/1945 | Thornley | 405/229 |
| 2,875,584 | 3/1959 | Turzillo | 405/229 |
| 3,040,411 | 6/1962 | Messenger | 405/229 |
| 4,253,781 | 3/1981 | Fischer et al. | 405/269 X |
| 4,507,069 | 3/1985 | Murray et al. | 425/59 |

FOREIGN PATENT DOCUMENTS

| | | | |
|---|---|---|---|
| 416698 | 9/1934 | United Kingdom | 405/229 |
| 658226 | 5/1979 | U.S.S.R. | 405/229 |

*Primary Examiner*—Dennis L. Taylor

[57] ABSTRACT

A compacted deep foundation structure, a method of and an apparatus for making such structure. This structure may be a pile made in situ, or prefabricated, a pile with enlarged footing, or without it, a micro-pile, a large-diameter pile, a pile without any skin bearing capacity, an underground wall portion, or the like. The foundation structure of the invention permits the foundation ground strength to be raised by compacting it, and reduces the settling of the structure. The compacted deep foundation structure includes a separate foot block pushed in the foundation ground, and a foundation body supported by the foot block and separated from it by space which is initially filled by a separator and later by hardenable material. In the foundation body there is provided at least one longitudinal through hole for accommodating a strut.

In accordance with the method of the invention, the separate foot block, once hardened, is pushed into foundation ground by strutting against the foundation body while, optionally, the surrounding ground is reinforced by a hardening material. In the apparatus preferably employed for performing the method of the invention, the foot block is pushed by using the strut supporting a linear vibrating or impact motor, together with a load distributing beam which is anchored in the foundation body, or, alternatively, in the overlying ground. The invention is applicable to the building and the testing of deep foundation structures.

10 Claims, 9 Drawing Figures

COMPACTED DEEP FOUNDATION STRUCTURE, METHOD OF AND APPARATUS FOR BUILDING THE SAME

The invention relates to compacted deep foundation structures, and particularly piles, large-diameter piles and underground walls, both prefabricated and constructed in situ, as well as to a method of and an apparatus which make it possible to raise the strength of the foundation ground by compacting, to reduce setting of the building, and to increase the bearing capacity of foundation structures by preloading them.

During processes of excavating drill holes, trenches and pits for deep foundation structures, the soil exposed to the action of drilling or excavating implements is loosened and rebounds. After excavating a hole, trench or pit, there arises on the bottom thereof a compressible layer of soil particles which deposit as sediment in water, or in a suspension, or, alternatively, a compressible filtering layer is created. Such a compressible layer cannot be compacted or consolidated either by placing prefabricated foundation blocks therein, or by filling up the drill hole, trench, or pit with concrete mix, but remains between the foundation ground and the foundation body until the foundation structure has been loaded by the building. This layer, together with the loosening, the rebounding and the relatively small compacting of the foundation ground, causes a slow mobilization of soil resistance under the deep foundation structure, said mobilization being in a disproportion with the mobilization of skin friction of the structure. Such a disproportion leads to a local and/or partial utilization of the soil resistance under the deep foundation structure within the range of deformations which are admissible from the viewpoint of the stress to which the building supported by the foundation is to be exposed.

In the West-German patent specification No. 1,215,603 a compacting foundation pile has been disclosed the bearing capacity of which is achieved during the building process, on the one hand, by compacting the ground and, on the other hand, by subsequently injecting it. An injection mix is forced into a star-shaped chamber provided in the pile footing, and is closed by a foot plate made of steel. Consequently, the foot plate bulges out, compacts the foundation ground, and when it has been torn off the pile, the injection mix can enter the foundation ground and consolidate it. However, the ground compacting effect is insufficient, since in porous and crevassed soils the foot plate is torn off prematurely, which means even though it has been exposed to relatively low pressure values, so that the injection mix is allowed to escape into pores and crevices in the soil. To the contrary, in relatively compact soils, such consolidation is limited by the weight and the skin friction of the pile.

With an analogous known compacting foundation pile (see West-German patent publication No. 2,613,993) the foot plate is replaced by a concrete piston. The piston is inserted tight into a partitioned steel tubing the inner wall of which is coated with a lubricant, while its outer wall is surrounded by a cement mix. After the setting of the latter, another cement mix is forced into the tubing, whereby the piston is driven into the foundation ground. A disadvantage of this process is in its relatively high manufacturing costs, in the necessity of fixing the concrete piston by subsequent injections, and in an insufficient compacting effect. The piston has to be made as a prefabricated element in a plurality of variants which distinguish from one another in shapes and dimensions, depending upon the type of deep foundation structure and on the presupposed foundation ground compressibility.

When considering the single use of the piston, the partitioned steel tubing and three pipes opening into the latter, the process does not appear to be advantageous. Since the subsequently forced cement mix cannot adhere to the lubricated inner wall of the steel tubing, and since after the driven piston an unfilled annular space, or an unconsolidated annular block of foundation ground is left under the pile, the pile footing has to be subsequently injected. For this purpose, there are provided in the concrete piston branched channels of stellar configuration, the central intake of which communicates via a hose with an injecting pipe disposed in a pressurized space above the piston. It is evident that such channels raise the labor requirements of the piston manufacture, and that the hose may cause some potentially irreparable failures. The degree of foundation ground consolidation is limited by the height in which the channels open out, and further by the weight as well as the skin friction of the pile. Apart from this, it is not possible with this pile type reliably to measure the forces acting upon the pile footing, by measuring the pressure of the injection mix, since a jamming or sticking of the concrete piston, a choking of the supply ducts, a setting of the injection mix, or the like, cannot be avoided.

In another known compacting pile foundation, not only the weight of the pile and the skin friction thereof but also the overlying ground are availed of for compacting the foundation ground (West-German patent publication No. 2,017,737). In this foundation, a covered elastic cushion, is disposed under an enlarged pile footing. The cushion, prior to the concreting process, is filled up with a supporting liquid substance which, after setting of concrete mix, is replaced by a hardening material, the foundation ground is consolidated and the reactive forces are absorbed by the weight and the skin friction of the pile as well as by the over-laying ground above its enlarged footing. Drawbacks of this process result from the use of the elastic cushion. If it is to withstand a relatively high pressure and to resist perforation, it must have rigid and thick walls which, however, allow only allow expansibility so that the compacting effect of the cushion is reduced. To the contrary, the elastic cushion tends to be perforated before the desired consolidation has been achieved, and before it has been possible to detect, by measuring the pressure of hardening material, the degree of previous load upon the foundation ground under the pile.

It is an object of the present invention to eliminate the drawbacks of the prior art as hereinbefore set forth, and to provide an improved compacting deep foundation structure which comprises, according type the invention, a separate foot block pushed into a foundation ground, and a foundation body which is arranged above said foot block and separated therefrom by a space at least one longitudinal through-hole for a strut being provided in said foundation body.

Depending upon the type of foundation ground and on the purpose of the deep foundation structure, the space can be filled up with a hardening material, and the strut accommodated in the longitudinal through hole bears upon the separate foot block, and/or said can be filled up with a hardening material.

The invention also provides a method of building the compacting deep foundation structure, the method comprising pushing the hardened separate foot block into the foundation ground by strutting it against the foundation body.

In case a relatively high reactive force is to be transmitted to the foundation body when pushing the separate foot block into the foundation ground, and in order to raise the bearing capacity of the foundation structure, it is preferable that before pushing the separate foot block into the foundation ground, the overlying ground surrounding the foundation body and/or the foundation ground under said separate foot block, or in surroundings thereof, is consolidated by a hardening material, or, alternatively, the strut is exposed to vibrations, or impacts.

If the joint is to be filled up with the hardening material, it is advisable to flush it first by pressurized water. However, the space can be simultaneously filled up with the hardening material with pushing the separate foot block into the foundation ground, without being flushed.

The invention also provides an apparatus for performing the method as hereinabove referred to, said apparatus comprising the strut carrying a linear vibrating or impact motor together with a distributing beam anchored in the foundation body.

With foundation structures which are built in reduced depths, or with structures built in soils characterized by a relatively low skin friction, the distributing beams supported by the linear vibrating or impact motor is loaded by a weight and/or anchored in the overlaying ground by provisional ground anchors.

The apparatus for carrying out the method of building the deep foundation structure according to the invention can comprise, optionally, at least one injecting pipe which is arranged in the foundation body and which engages either into the space, or to below the separate foot block.

When considering the necessity of re-injection, the injecting pipe, within the range of the foundation body and/or the separate foot block, is preferably made axially movable in a protective tube.

The space can be flushed before being filled up with the hardening material, if the injecting pipe is provided with a non-return valve and if it communicates with a flushing pipe the mouth of which is above the foundation body.

Advantages of the compacting deep foundation structure according to the invention as well as of the method of building the same manifest themselves above all in the wide range of application thereof, in the degree of foundation ground consolidation achieved, and in reduced costs to be expended on the manufacture thereof. The compacted deep foundation structure can be constituted by a long pile, both made in situ, or prefabricated, a pile with enlarged footing, or without it, a micro-pile, a large-diameter pile, a pile without any skin bearing capacity, an underground well, or the like. A more effective consolidation of the structure is achieved in that for compressing the foundation ground, it is possible to make use of reactive forces generated by skin friction at the surrounding ground, by the weight of the foundation structure, by the stability of the overlaying ground above the enlarged foundation foot, by an additional load, or by an auxiliary anchoring.

The consolidation degree is not limited by the reactive force, or by preselected disposable aids which have been predimensioned according to a presupposed compressibility of foundation ground. The consolidation degree can be raised by increasing the skin friction of the separated foundation foot portion by forcing the hardening material into the ground in the surroundings thereof whereby a higher thrust can be imparted to said separate foundation foot portion. The bearing capacity of this portion can be further raised by injecting both the surrounding ground and the foundation one which can be effected prior to, or also after pushing the separate foot block, or by exposing the strut to the action of a vibrator, or a ram whereby the foundation ground under the pushed separator foot block is subsequently compacted.

Relatively low costs make it possible to repeatedly apply almost all of the known technical means for pushing the separated foot block into the foundation ground and for compacting the latter under said block. For filling up the space between the separate foot block and the foundation body, pressurized cement supplying means can be optionally availed of. During the compacting process, it is possible to reliably measure the bearing capacity of the deep foundation structure on both the foot and the skin, and particularly up to limit values, unlike the hitherto known measuring methods which permit the bearing capacity to be measured only up to the balance between the forces to which the foot block is exposed and the reactive forces.

Some preferred embodiments of the compacting deep foundation structure according to the invention will be hereinafter described with reference to the accompanying drawings. In the drawings.

Figure 1:
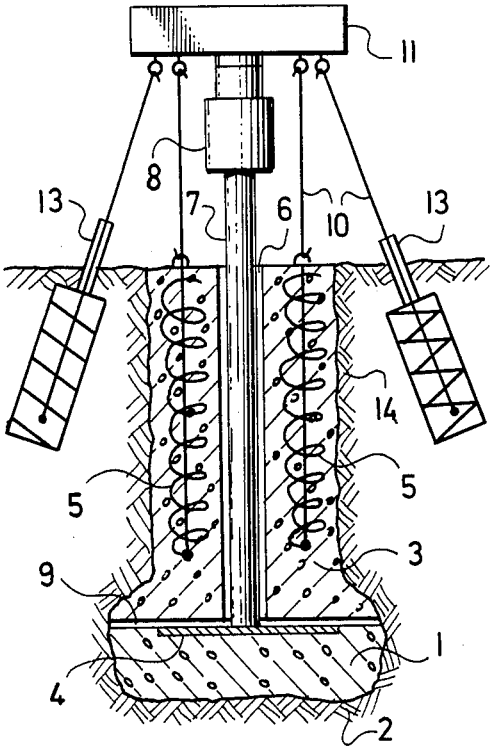
FIG. 1 Shows a longitudinal sectional view of a first embodiment of the compacting deep foundation structure embodied as a compacting pile having an enlarged foot before pushing a separate foot block into the foundation ground.
Figure 2:
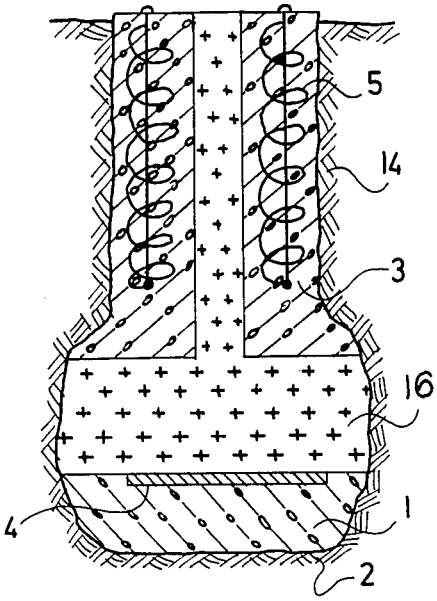
FIG. 2 Is a similar view of the same pile as shown in FIG. 1 after the separate foot block has been pushed into the foundation ground.
Figure 7:
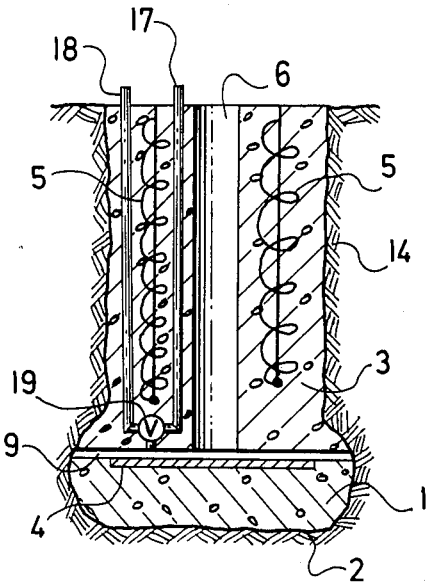
FIG. 7 Shows a longitudinal sectional view of a fifth embodiment of the compacting pile together with the injecting pipe and a flushing pipe.
Figure 8:
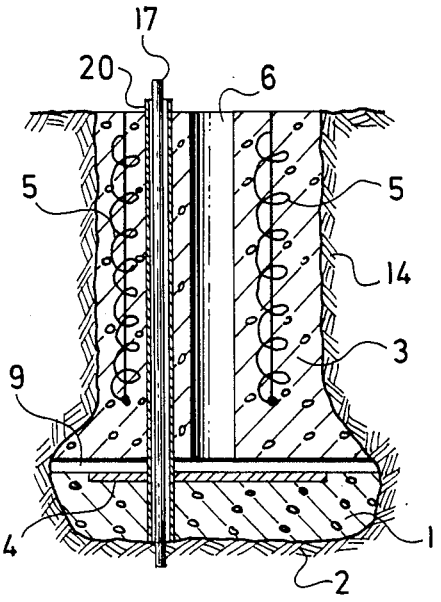
FIG. 8 Shows a longitudinal sectional view of a sixth embodiment of the compacting pile together with a protective tube, before pushing the separate foot block into the foundation ground.

As can be seen in the drawings, and particularly FIG. 1 thereof, the compacted deep foundation structure includes a separate foot block 1 and a foundation body 3, both of which are dipped in a foundation ground 2 and an overlying ground 14. Between said block 1 which is reinforced by a reinforcing plate 4, and the foundation body 3 which is reinforced by reinforcing elements 5, or, alternatively, a flanged casing 15 (FIGS. 3, 4), a space 9 is provided. In the foundation body 3 there is provided a longitudinal through hole 6 for accommodating a strut 7 which, depending upon the type of deep foundation structure to be made, either permanently bears on the separate foot block 1, as shown in FIG. 4, or is removed, and said longitudinal through hole 6, including the space 9, is filled up with a hardening material 16, as shown in FIG. 2. The separate foot block 1 is pushed into the foundation ground 2 by means of a device comprising the strut 7 supporting a linear vibrator or thrusting motor 8 together with a load distributing beam 11 which is anchored by anchor ropes 10 in the foundation body 3, or, alternatively, by provisional ground anchors 13 in the overlying ground 14. The distributing beam 11 can be also loaded by a weight 12. The apparatus for carrying out the method of building the compacted deep foundation structure also comprises an injecting pipe 17 (FIG. 7) located in the foundation body 3, or alternatively, in the separate foot block 1. As can be seen in FIG. 8, the injecting pipe 17 can be accommodated in a protective tube 20, or preferably in FIG. 7, provided with a non-return valve 19 and communicates with a flushing pipe 18, such arrangement permitting the pipe 17 to be flushed.

The following examples are given as illustrative only without, however, limiting the invention to the specific details thereof.

EXAMPLE 1

(FIGS. 1 and 2)

In the foundation ground 2 there was cast the separate foot block 1 which was reinforced by the reinforcing plate 4 (FIG. 1). On said separate foot block 1 there was erected from a concrete mix the foundation body 3 which was separated therefrom, e.g. by a foil having a time-solubility, and which included the reinforcing elements 5. By means of a removable core (not shown in FIG. 1) the longitudinal through hole 6 was provided in said foundation body 3. After the setting of the concrete mix, the strut 7, together with the linear motor 8 overlapping the top level of the foundation body 3 was inserted into the through hole 6. On the linear motor 8 there was placed the load distributing beam 11 which was then anchored by anchor ropes 10 to said reinforcing elements 5 of the foundation body 3.

By starting said linear motor 8, a thrust was imparted to the separate foot block 1 whereby the foundation ground 2 was compacted. Reactive forces were compensated for by the weight of the foundation body 3, a skin friction thereof, and by the overlying ground 14. The output of the linear motor 8, which means the intensity of the thrust imparted to the separate foot block 1 and constitutes a function of the bearing capacity of the foundation structure or pile, was being monitored on an additional dynamometer (not shown). Since the foundation body 3 was not capable of absorbing the reactive forces acting against the chosen thrust value corresponding to the predimensioned bearing capacity of the pile, there were installed in the environment of the foundation body 3 the provisional ground anchors 13 which were fixed by the anchor ropes 10 to the load distributing beam 11. The separate foot block 1 was now exposed to a continuing thrust until such degree of foundation ground consolidation had been achieved to correspond to the predimensioned bearing capacity. After removing the strut 7 and the provisional ground anchors 13, the space 9, which has now become enlarged, and the longitudinal through hole 6 were filled up with hardening material 16 (FIG. 2)

EXAMPLE 2

Figure 3:
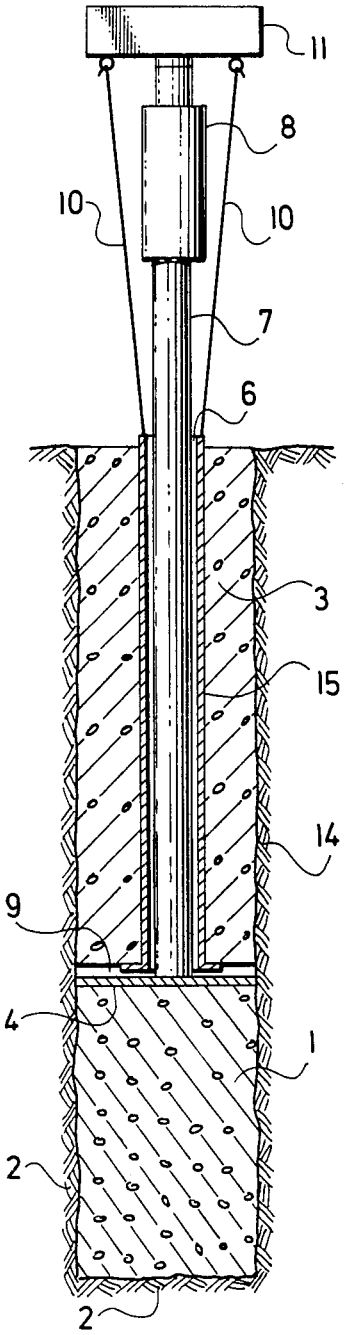
FIG. 3 Shows a longitudinal sectional view of a second embodiment of the compacting deep foundation structure embodied as a compacting pile, before pushing the separate foot block into the foundation ground, the bearing capacity of the foundation body skin being excluded.
Figure 4:
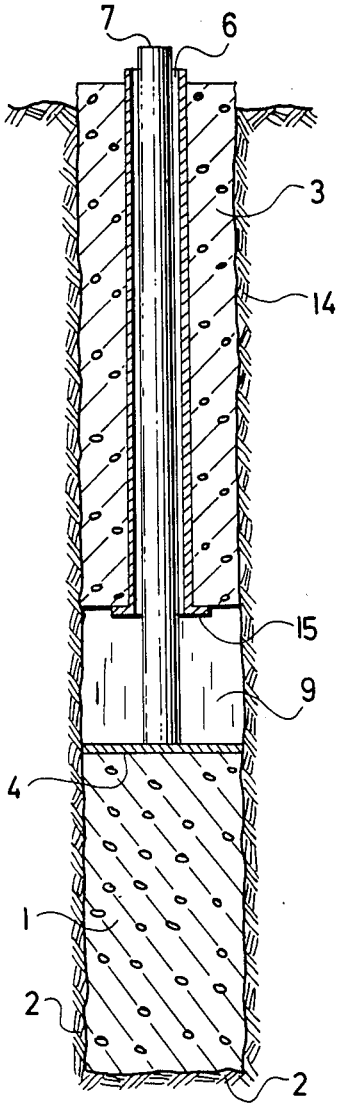
FIG. 4 Is a similar view of the same pile as shown in FIG. 3 after the separate foot block has been pushed into the foundation ground.

(FIGS. 3 and 4)

As can be seen in FIG. 3, to avoid the bearing capacity caused by skin friction upon the foundation body 3, and to prevent a surcharge as well as a settlement of adjacent building structures (not shown), a foundation pile structure was built. Since in this case the strut 7 permanently bears upon the separate foot block 1, the flanged casing 15 used for providing the longitudinal through hole 6 was left in the foundation body 3 as a reinforcing element. Similarly to Example 1, the separate foot block 1 (FIG. 4) was given in the foundation ground 2 by means of the linear motor 8, the load distributing beam 11 and the anchor ropes 10 fixedly attached to the flanged casing 15. In this way the foundation ground 2 was consolidated and its strength as well as bearing capacity increased. Since the compacting foundation pile structure of the invention was loaded via strut 7 solely on the separate foot block 1, the longitudinal through hole 6 and the space 9 were not filled up with hardening material.

EXAMPLE 3

(FIG. 5)

Figure 5:
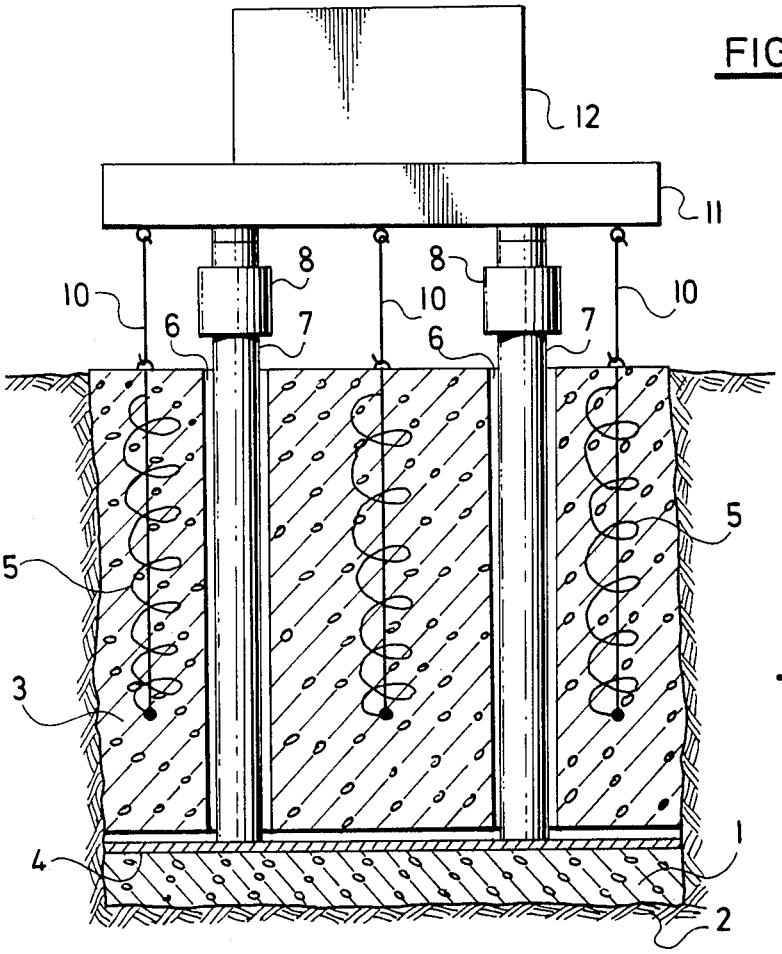
FIG. 5 Shows a longitudinal sectional view of a third embodiment of compacting deep foundation structure embodied as a portion of a compacting underground wall, before the separate foot block has been pushed into the foundation ground.

An underground compacted wall according to the invention was built (FIG. 5). On the separate foot block 1 made in the foundation ground 2 there was erected the foundation body 3 having the reinforcing elements 5 and two longitudinal through holes 6. Into said holes 6 there were inserted struts 7 supporting the respective linear motors 8 and the load distributing beam 11 which was anchored by ropes 10 to the reinforcing elements 5 of the foundation body 3. The process corresponded to that referred to in Exampele 1. In lieu of the provisional ground anchor 13, an additional weight 12 was used. The space 9 was filled up with hardening material 16 by means of an injector with an obturator (not shown) fixed in the unfilled bottom parts of the holes 6.

EXAMPLE 4

(FIG. 6)

Figure 6:
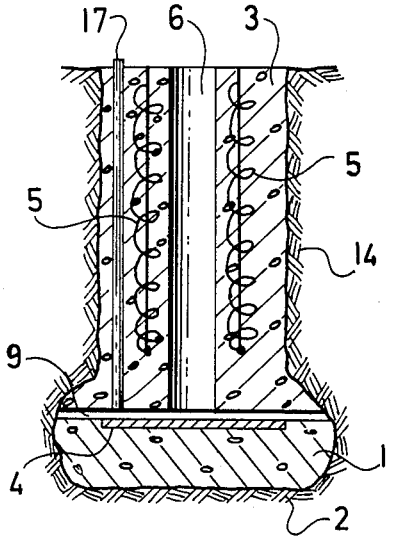
FIG. 6 Shows a longitudinal sectional view of a fourth embodiment of the compacting pile together with an injecting pipe.

In the foundation body 3 of the compacted deep foundation structure as shown in FIG. 6, an injecting pipe 17 was installed so as to engage into the space 9. While driving the separate foot block 1 into the foundation body 3, the space 9, which was increasing in size was simultaneously being filled up with hardening material forced through said pipe 17. In this way the soil from the overlying ground 14 was prevented from entering the space 9.

EXAMPLE 5

(FIG. 7)

In the foundation body 3 of the compacted deep foundation structure shown in FIG. 7, there was arranged an injecting pipe 17 which engaged into the space 9. The pipe 17 was provided with the non-return valve 19 and was adapted for communication with the flushing pipe 18. After pushing the separate foot block 1 into the foundation ground 2 as described in Example 1, the space 9, with the strut 7 having been left in the longitudinal through holes 6, was flushed at first by pressurized water and then filled up with hardening material forced through the injecting pipe 17, while the flushing pipe 18 was being obturated. After the hardening material had set, the strut 7 was coupled to a vibrator (not shown), and the foundation ground 2 under the separate foot block 1 was subsequently compacted. The thus arisen crevices in the filling of the space 2 were refilled by the injecting pipe 17.

EXAMPLE 6

Figure 9:
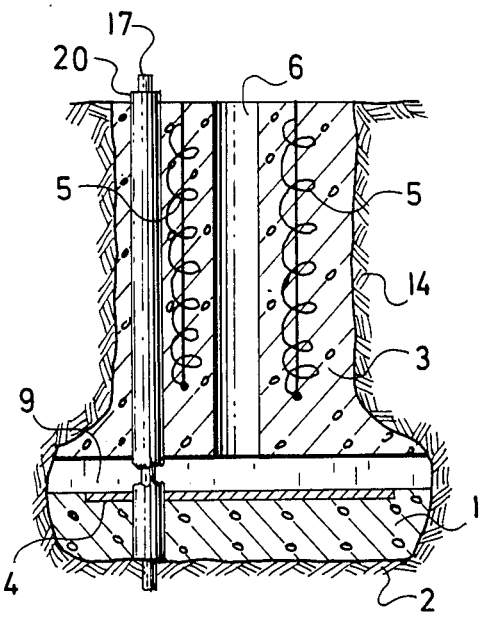
FIG. 9 is a view in longitudinal section of the sixth embodiment of the compacting pile after the separate foot block has been driven into the foundation ground and the injecting pipe has been reinserted into the protective tube which had ruptured during the pushing process, the space produced by such pushing process having been filled up with hardening material.

(FIGS. 8 and 9)

The compacted deep foundation structure in the form of a compacted pile with enlarged foot was made in a cohesionless foundation ground 2 (FIG. 8). In the separate foot block 1 as well as in the foundation body 3 there was provided a protective tube 20 for accommodating an injecting pipe 17 for consolidating the foundation ground 2 under said separate foot block 1 by forced hardening material. Apart from this, the overlying ground 14 in the environment was injected. In a manner similar to that as described in Example 1, the separate foot block 1 was pushed, after several flushings, into the consolidated foundation ground 2. The effectiveness in compacting the foundation ground, owing to the foot block driving process, was substantially augmented by the reinforced overlying ground 14 and consequently by skin friction of the foundation body 3 which was rendered capable to absorb relative high values of reactive forces. After driving the separate foot block 1 into the foundation ground 2, the injecting pipe 17 (FIG. 9) was reinserted into the protective tube 20 which had ruptured during the pushing process, and the space 9 was filled up with hardening material supplied through the longitudinal through hole 6. After setting the hardening material, the foundation ground 2 was reinjected and also the hardened filling in the space 9 was injected through the retracted injecting pipe 17.

Simultaneously with building the compacting deep foundation structure according to the invention, it is possible to test and measure the bearing capacity thereof. Thus the invention is applicable for both raising the bearing capacity of such structures and for testing it.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. An apparatus for building a compacted deep foundation structure, comprising a separate foot block pushed into a foundation ground, a foundation body which is arranged above said foot block and separated therefrom by a space, at least one through hole for a strut being provided in said foundation body, a strut in said through hole, a load distributing beam anchored in said foundation body and a linear motor disposed between said strut and said load distributing beam.

2. An apparatus as claimed in claim 1, wherein the load distributing beam is provided with a weight.

3. An apparatus as claimed in claim 1, wherein the foundation body there is arranged at least one injecting pipe engaging into the space.

4. An apparatus as claimed in claim 3, wherein the injecting pipe extends to below the separate foot block.

5. An apparatus as claimed in claim 3, wherein the injecting pipe extends within the range of the foundation body and is axially movable in a protective tube.

6. An apparatus as claimed in claim 3, wherein in the injecting pipe is provided with non-return valve and communicates with a flushing pipe the inlet end of which is disposed above the foundation body.

7. An apparatus as claimed in claim 1, wherein the load distributing beam is anchored in the overlying ground.

8. An apparatus as claimed in claim 1, wherein the foundation body is provided with a weight.

9. An apparatus as claimed in claim 1, wherein the foundation body is anchored in the overlying ground.

10. An apparatus as claimed in claim 3, wherein the injecting pipe extends within the range of the separate foot block and is axially movable in a protective tube.

* * * * *